United States Patent [19]

Jacobs

[11] Patent Number: 4,528,917

[45] Date of Patent: Jul. 16, 1985

[54] SOLID FUEL BURNER

[75] Inventor: Clifford S. Jacobs, Fargo, N. Dak.

[73] Assignee: Northwest Iron Fireman, Inc., Fargo, N. Dak.

[21] Appl. No.: 510,573

[22] Filed: Jul. 5, 1983

[51] Int. Cl.[3] ..... F23H 3/00

[52] U.S. Cl. ..... 110/300; 110/101 CF; 110/104 R; 110/259; 110/266; 110/267

[58] Field of Search ..... 110/244, 248, 255, 256, 110/257, 259, 266, 267, 291, 300, 327, 102, 103, 104 R, 273, 281, 101 C, 101 CF; 126/152 R, 163 R, 163 A

[56] References Cited

U.S. PATENT DOCUMENTS

| | | | |
|---|---|---|---|
| 494,375 | 3/1893 | Grigsby . | |
| 505,748 | 9/1893 | Campbell | 110/282 |
| 603,076 | 4/1898 | Day . | |
| 826,122 | 7/1906 | Small | 110/300 |
| 1,119,808 | 12/1914 | Coates | 110/300 |
| 1,621,241 | 3/1927 | Drake | 110/267 |
| 1,644,953 | 10/1927 | Seyboth | 110/281 |
| 2,072,450 | 3/1937 | Hobson, Jr. | 110/266 |
| 2,253,694 | 8/1941 | Drawz | 100/45 |
| 3,777,677 | 12/1973 | Ali et al. | 110/8 |
| 3,841,242 | 10/1974 | Sigg | 110/257 |
| 3,865,053 | 2/1975 | Kolze et al. | 110/7 |
| 4,027,602 | 6/1977 | Mott | 110/7 |
| 4,184,436 | 1/1980 | Palm et al. | 100/102 |
| 4,239,029 | 12/1980 | Martini et al. | 110/281 |
| 4,268,274 | 5/1981 | Caughey | 110/273 |
| 4,292,904 | 10/1981 | Grandt | 110/103 |
| 4,311,102 | 1/1982 | Kolze et al. | 110/103 |
| 4,354,440 | 10/1982 | McRee, Jr. | 110/244 |

*Primary Examiner*—Edward G. Favors
*Assistant Examiner*—Steven E. Warner
*Attorney, Agent, or Firm*—Kinney & Lange

[57] ABSTRACT

A solid fuel burner comprises a system which permits solid fuel to be injected into a burner chamber and intermixed in an air suspension. The burner includes a cast iron, stepped grate that is self-cleaning, and comprises a series of plates that are substantially horizontal and are vertically spaced apart to form steps. Air is introduced under the stepped plates and the air blows out into the combustion chamber through the spaces between the plates to aid in combustion and cause turbulence in the fuel introduced. The burner further includes a "pin hole" grate adjacent the stepped grate on which lighter materials will fall and will be also subject to an air stream for complete combustion, and efficient burning.

4 Claims, 3 Drawing Figures

Fig. 1
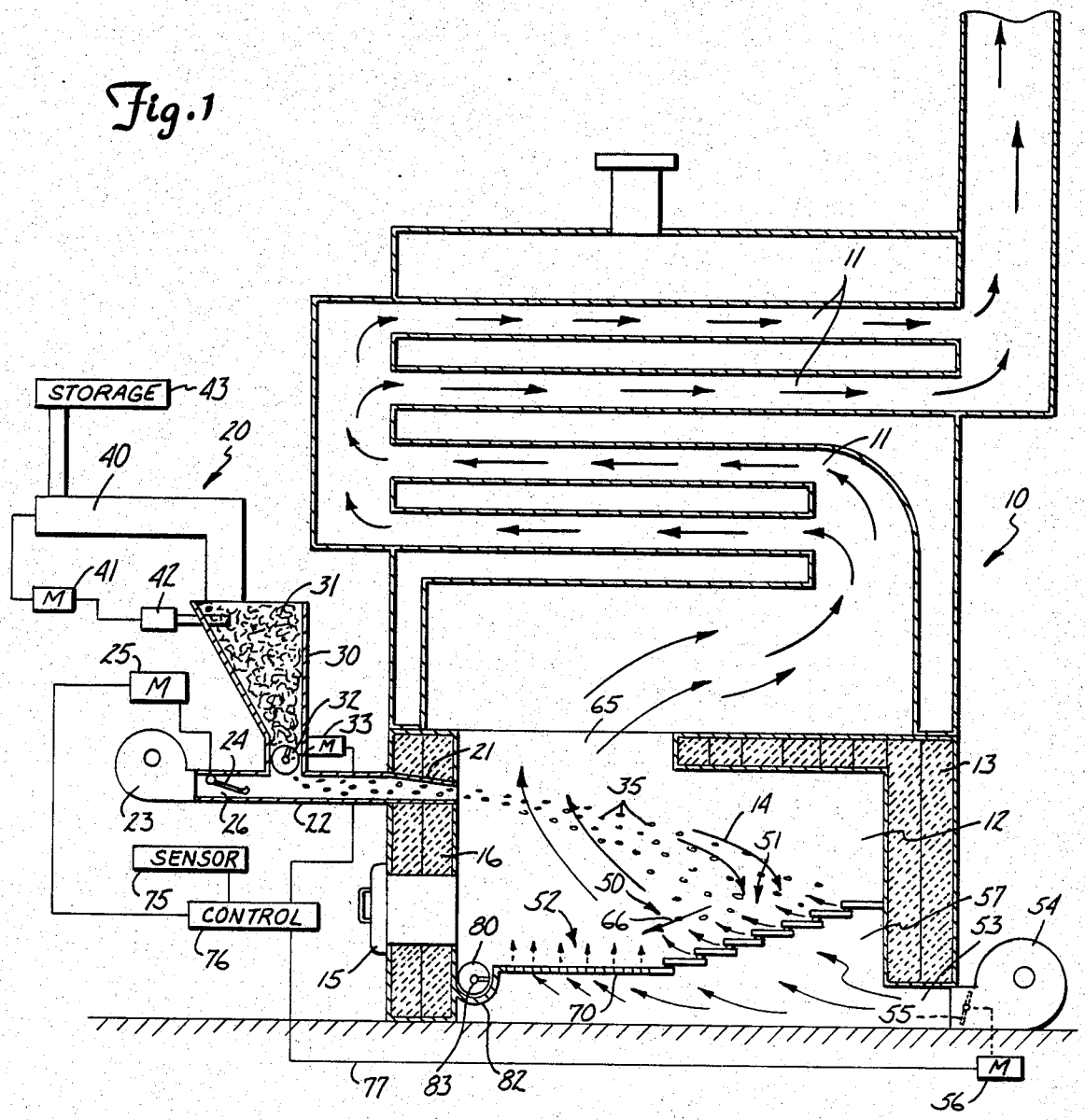
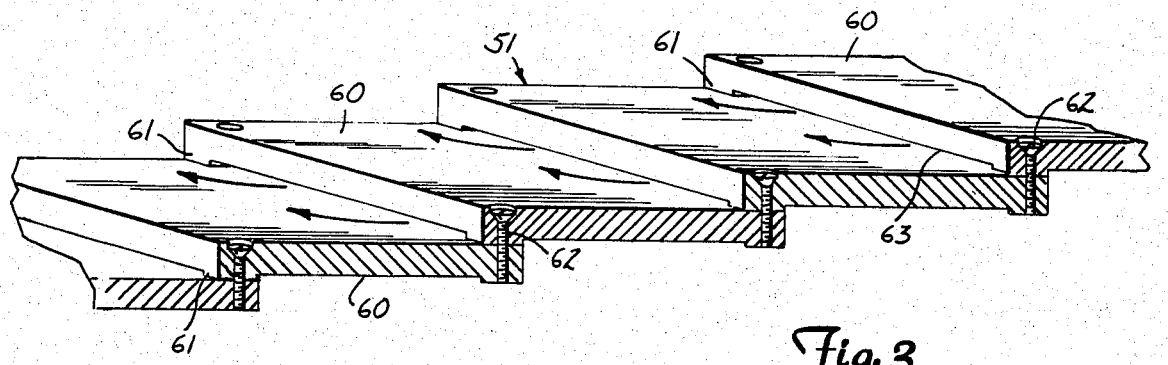
Fig. 3

SOLID FUEL BURNER

BACKGROUND OF THE INVENTION

1. Field of the Invention

The present invention relates to solid fuel burners, and in particular burners which include grates that will permit highly efficient burning of materials.

2. Description of the Prior Art

In the prior art, various combustion chamber constructions for burning different materials have been advanced. In particular, burners that use an air suspension for introducing the material to be burned have been shown. U.S. Pat. No. 603,076 shows a burner that suspends fuel particles in an airstream and then introduces the fuel into a burner of substantially conventional design. Entraining the fuel in the fluid stream before the fuel is fed into the furnace is shown in this patent. Also, U.S. Pat. No. 494,375 shows a pulverized fuel feeder that includes an airstream for carrying the fuel into the burner, as does U.S. Pat. No. 3,777,677, which is a waste material burner that suspends products in an airstream and feeds them in a combustion chamber.

U.S. Pat. No. 3,865,053 shows a burner designed for burning sawdust, which includes a form of a venturi through which an airstream entraining the material passes. U.S. Pat. No. 4,311,102 shows a similar arrangement, using an airstream for entraining the materials.

U.S. Pat. Nos. 4,027,602 and 4,184,436 show burners that are used for air entrained combustion materials.

A stacked grate that uses vertically spaced annular rings or plates is shown in U.S. Pat. No. 2,253,694 to Drawz. The rings are placed on top of each over a central fuel feed tube, and coal is forced through the opening and spilled over onto the rings and burned. This includes a deflecting lip at the outer end of the edges of the rings.

However, none of the prior art patents show a burner which provides for the efficient use of a burning material such as pelleted sunflower seed hulls, woodchips, pelleted sawdust, or other biomass materials, in an efficient manner wherein the material is entrained in an airstream and blown into a furnace burner area having generally flat stacked plates along one side, with an adjacent pin hole grate used in combination.

SUMMARY OF THE INVENTION

A solid fuel burner includes a feed mechanism for introducing solid fuel in an air suspension into a burner combustion chamber of substantial size. The fuel is directed toward a stepped grate that is made of a plurality of flat plates spaced apart in vertical direction and positioned generally horizontally. Air is blown through the spaces between the plates so that material falling on the plates will be subjected to moving air which creates turbulence to promote combustion. Dust and fine particles are burned in suspension before reaching the grates. The air from the spaces also carries lighter material laterally of the stepped plate grate, and over onto a second combustion area comprising a generally flat plate with smaller holes through it through which air is supplied for promoting combustion. The air provides a self-cleaning action.

An ash removal auger can be provided adajcent one side of the burner chamber, for removing ashes that are blown over to the auger by the air blast from the high pressure air of the burner.

Suitable controls of a known type can sense the boiler demand, and control the rate of feed from a supply auger to a hopper used with the air blower that is used to blow the fuel into the burner chamber. Likewise, the velocity of the air through the burner can be controlled by suitable sensors and controls.

The fuel is injected through a nozzle in an air suspension, and an adjustable venturi can be utilized for controlling the intermixing of air and solid fuel. By intermixing the fuel and air as the fuel is introduced, the fuel tends to be kept suspended as it falls over onto the stepped grates, and actual combustion occurs while the fuel is falling through the air, as well as while it is on the grates. The flow of the high pressure air from the stepped grates is a counter direction flow to the fuel input air and flows through the input fuel feed stream so that there is turbulent action tending to agitate and mix the fuel materials and promote full combustion.

BRIEF DESCRIPTION OF THE DRAWINGS

FIG. 1 is a part schematic representation of a typical furnace having a combustion chamber made according to the present invention;

FIG. 3 is a perspective sectional view of a stepped grate made according to the present invention.

DETAILED DESCRIPTION OF THE PREFERRED EMBODIMENT

Figure 2:
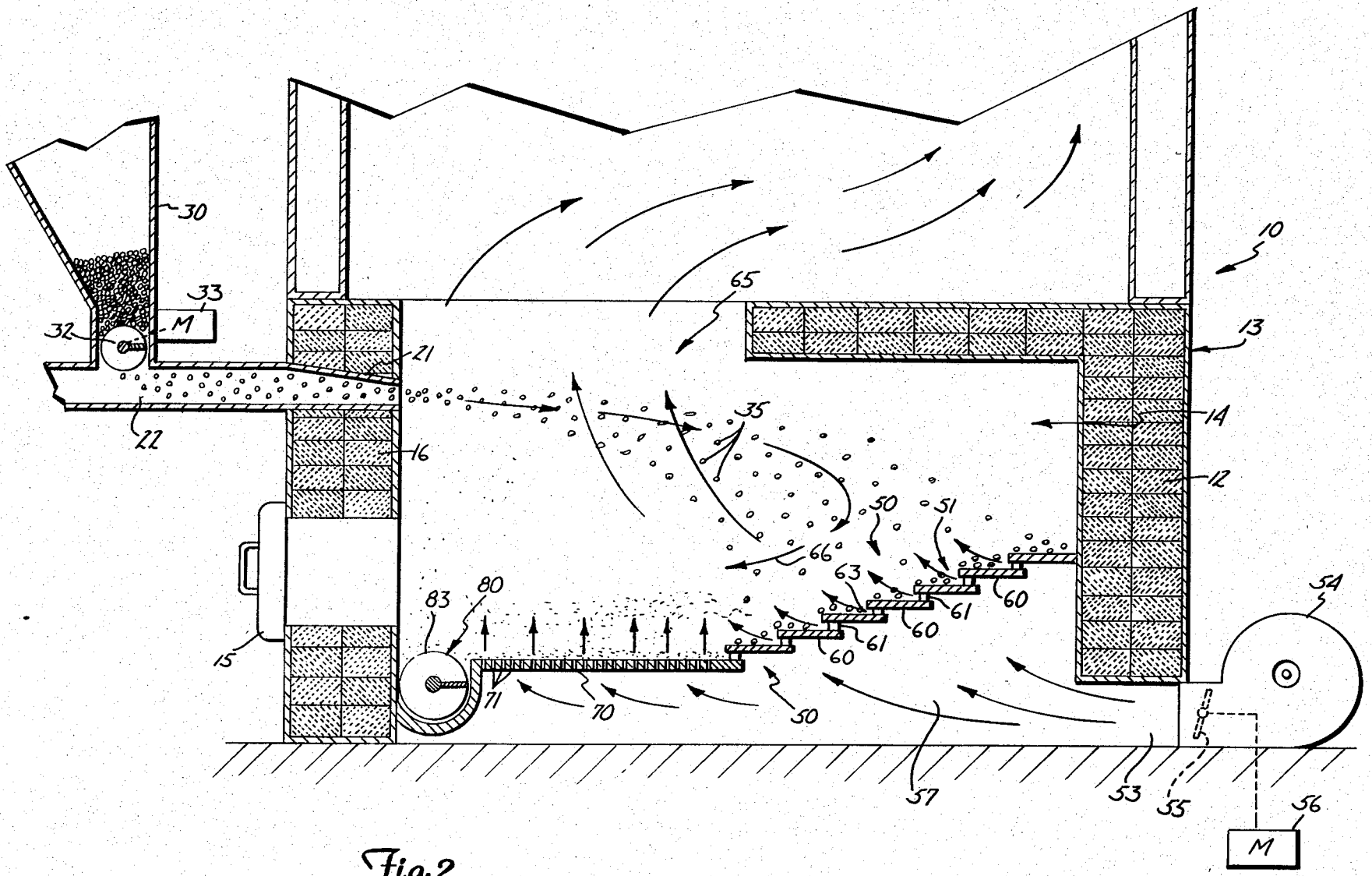
FIG. 2 is an enlarged fragmentary sectional view of the combustion chamber made according to the present invention.

In FIG. 1, a typical boiler assembly indicated generally at 10 is shown only shcematically to show that it provides channels or paths indicated generally at 11 for products of combustion from a burner 12 positioned below the boiler section. The burner 12 comprises a housing 13 that is lined with refractory materials, in the usual manner, and forms an interior burner chamber 14 of substantial size. The chamber 14 has an access door 15 on one wall thereof which is used for inspection and servicing purposes, and a fuel feed assembly indicated generally at 20 is positioned to one side of the housing 13. The fuel feed assembly includes a fuel feed nozzle indicated generally at 21 that extends through the front wall 16 of the housing, and this nozzle 21 in turn is connected to an air passage tube or duct 22 supported in a conventional manner laterally of the housing 13. The duct 22 is connected to the output of a high pressure air fan 23 of the normal variety that is driven in a suitable manner, for example by a variable speed motor (not shown). A damper blade indicated at 24 extends across the duct 22 and is adjustable with a damper motor 25 to form a venturi indicated generally at 26 of variable size. The motor 25 can be controlled to control the size of the venturi by pivoting the damper 24 to different positions.

On the top side of the duct 22 as shown schematically, there is a storage hopper 30 for solid fuel materials indicated generally at 31 in the hopper. The solid fuel is particulate material, such as pellets of sunflower hulls or sawdust, wood chips, ground rubber, coal or spoiled farm produce, such as corn or sunflowers.

The hopper 30 has a feed control 32 of conventional design that is operated by a motor 33 to feed fuel materials into the duct 22. When the fan 23 is operating, the fuel will fall into the airstream in the duct 22 flowing past the venturi 26 so that air will carry the solid fuel material particles out through the nozzle 21 into the chamber 14. The pellets or particles of fuel materials are shown schematically at 35 in the chamber 14.

A fuel supply auger 40 leading from a storage bin 43 or the like can be controlled by a motor 41 that in turn operates in response to a level sensor 42, operable to maintain the level in the hopper 30 at a desired level. The auger 40 is a fuel supply auger that is of conventional design and comes from a large capacity storage bin. The output of hopper 30 is controlled for the actual feeding of material through the feed element 32 in a conventional manner.

The combustion chamber 14 includes a grate assembly 50. There are two sections to the grate assembly 50, including a first stepped plate grate indicated generally at 51 on the opposite side of the chamber 14 from the wall 16 and inlet nozzle 21, and a secondary pin hole, flat plate grate 52, which is between the stepped grate 51 and the wall 16.

As shown, the combustion chamber has an air inlet opening 53 below the grate assembly 50 which is open to the output of a high pressure fan 54 that is driven by a suitable motor (not shown). The output duct of the fan is controlled by a damper 55 operating from a damper motor 56. The damper 55 controls the amount of air being introduced through the passageway 53 to the plenum chamber 57 directly below the grate sections 51 and 52.

The first grate section is the step grate 51, and as shown perhaps best in FIG. 3, the step grate 51 comprises a plurality of individual flat, unperforated plates 60 that are arranged as steps. The plates are coextensive longitudinally and partially overlap to form the steps with surfaces that progress generally downwardly from the wall opposite from the injection nozzle 21.

The plates 60 are made of suitable material such as cast iron, and suitable spacers indicated generally at 61 are formed on the bottom of each of the plates. The plates 60 are fastened together with suitable fasteners, shown schematically as screws 62. After the plates have been assembled there is a transversely elongated relatively narrow slot-like air space 63 between each of the plates 60 forming the step grate 51. Air from the plenum chamber 57 then can flow outwardly through these slot-like openings, first in a generally horizontal direction, which is the orientation of the planes of the plates 60, into the chamber 14. This provides a high pressure blast of air that tends to move up toward the combustion chamber outlet indicated at 65. It can be seen that this air from the openings will come into contact with the pellets or particles 35 being introduced into the combustion chamber and actually flow across the fuel carrying airstream. This cross flow causes turbulence and mixing of the fuel and air.

The lighter particles of fuel start to burn prior to striking the stepped grate 51. The heavier particles fall on the grate and are distributed on the grate. During the burning process the particles are reduced to light ash. The lighter particles and ash are blown by the air blast from openings 63 off the plates toward the pin hole grate section 52 where they are totally consumed.

The pin hole grate section 52 comprises a flat, perforated plate 70 which is supported in the combustion chamber 14, and as can be seen is spaced upwardly from the bottom wall of housing 13 so that air from the blower 54 also flows under this grate. The perforated plate 70 has a plurality of pin holes or small holes 71 spaced at desired intervals through which air may flow directly upwardly. The lighter fuel and ash particles are blown upwardly by this airflow and combustion is completed as the particles rest on the flat plate grate portion 52, comprising the plate 70 having the pin holes 71 in it. The plate 70 is directly below the outlet 65, as shown, and air flowing through the pin holes moves upwardly across the fuel carrying airstream to the outlet.

The combustion proceeds at a rate which is determined by a control from the boiler section temperature as sensed by a suitable sensor 75 operating through conventional controls 76 to control the motor 56 from a signal on line 77 and thus control the position of damper 55. The controls 76 also control the rate of feed of fuel by operating the motor 33 so the correct amount of air is provided by fan 54 for the fuel being burned.

Thus, the fuel feed rate and the undergrate air supply is controlled by the boiler demand.

The spacing between the flat plate 60 is generally approximately one-eighth of an inch, and forms a narrow slot of substantial horizontal length to provide a good strong blast of air to keep material moving and intermixing as it is being burned. The plates 60 are fixed in place and narrow and long. The plates extend completely across the combustion chamber, from one side to the other.

A further feature is the air suspension of the solid fuel pellets shown at 35 in the duct 22 and nozzle 21 from the air of blower 23 as they are fed into the combustion chamber. This provides for maintaining the particles surrounded by combustion air as they are introduced into the chamber, so that combustion can commence as soon as the ignition temperature is reached even if the particles are not in the burning mass on the grate assembly 50.

In a preferred embodiment the plates 60 were three inches wide, three feet long and about $\frac{1}{2}$ inch thick. The overlap was about $\frac{3}{4}$ of an inch to provide a $2\frac{1}{4}$ inch wide horizontal surface for burning. The space between plates was about $\frac{1}{8}$ inch to form the air openings 63.

The burner is self-cleaning in that most materials will be consumed and ashes are blown out of the way. Further, at present intervals the controls will automatically close the fuel supply off and open the valve 55 for fan 54 full open to clear the grate. Typically this action will be from one to three minutes. At the end of this cycle, typically once per hour, all operations go back to fuel feed and air volume controlled by boiler demand. An out fire switch may also be provided to prevent unburned fuel from accumulating in the combustion chamber.

The air conveying of the fuel can be used with wood pellets, pelleted sunflower hulls or similar particulate materials. The airflow paths aid in the burning process, and the slant, stepped grate on the opposite side from the fuel input nozzle provides a high pressure blast of air for moving lighter materials laterally at the same time that combustion is promoted. The heavy materials will tend to move down the grate, and as the fuel burns and becomes lighter the particles will be blown by the air over onto the pin hole grate for completing the combustion.

As shown in FIGS. 1 and 2, and ash removal auger assembly 80 is provided adjacent one side of the combustion chamber housing opposite from the stepped grate 51. The auger assembly 80 includes an auger housing 82 and an auger member 83 driven by a motor in a suitable manner and arranged to discharge ashes and materials collecting therein laterally out through a provided opening.

The plates forming the stepped grate are easily made and when positioned on a side of the combustion chamber opposite from the fuel input opening the air from the grate openings cause turbulent mixing of the fuel as it moves into the chamber. The hot gases carried in the air from the grate adds heat to the new fuel particles as they move toward the grate.

The fuel is fed over the entire top of the grate system. The air openings 63 and horizontal grate surface are designed to allow the fuel to burn on the surface with the air stream furnishing combustion air and when the fuel has burned into a lighter mass or ash, the horizontal travel of the air during normal operation, or in particular when the controls open the undergrate fan valve momentarily to full open, the particles on the stepped grates are blown to the pin hole grate area where vertical air streams and high reflected temperatures reduce it to a white ash. The grate material has a long life as there is continuous air travel through the air openings to control temperature of the grates themselves to an acceptable level.

Although the present invention has been described with reference to preferred embodiments, workers skilled in the art will recognize that changes may be made in form and detail without departing from the spirit and scope of the invention.

What is claimed is:

1. A combustion chamber combination including a housing having a bottom wall and spaced apart side walls and a top wall defining an outlet opening adjacent a first side wall;

a grate assembly mounted in the housing adjacent the bottom wall generally laterally positioned relative to the outlet opening and comprising a first grate section adjacent a side wall opposite the first side wall of said combustion chamber comprising a series of stationary substantially imperforate plate members arranged into a plurality of steps descending from the side wall in direction toward the first side wall, adjacent steps having overlapping edge portions and being spaced in direction of rise of the steps to define laterally facing elongated step openings between the steps extending along the length of the steps, the steps forming a plenum chamber below the steps;

a generally horizontal perforated plate spaced upwardly from the bottom wall and adjoining the lower portions of the first grate section, the plenum chamber including a portion below the perforated plate;

means to introduce solid fuel material into the chamber comprising means for providing an airstream entraining solid fuel particles and for carrying and directing said solid fuel particles from the first side wall of said chamber toward the second side wall, across the space defined by the outlet opening to fall onto the first grate section, the airstream carrying the solid fuel particles being introduced at a level above the first grate section and below the top wall; and a fan having a fan outlet to provide an airflow into the plenum chamber to cause discharge of air from the step openings defined between the adjacent steps into said combustion chamber, the step openings directing air across the upper surfaces of the respective steps and against material resting on the steps in lateral direction toward the housing outlet opening, and through the perforations in the perforated plate, airflow from the step openings defined between adjacent steps and from the perforations in the perforated plate flowing across the path of solid fuel particles as the airflows nove toward the housing outlet.

2. The apparatus of claim 1 and ash removal means for removing ashes from the combustion chamber, the ash removal means being positioned adjacent a wall of the combustion chamber opposite from the first grate section, said perforated plate extending from the first grate section to the ash removal means.

3. The apparatus as specified in claim 1, wherein the perforated plate is positioned substantially directly below the outlet opening, and said top wall overlies a substantial portion of the first grate section.

4. The apparatus as specified in claim 1, wherein the plate members forming the steps are substantially planar on their upper surfaces, and extend horizontally.

* * * * *

UNITED STATES PATENT AND TRADEMARK OFFICE

CERTIFICATE OF CORRECTION

PATENT NO. : 4,528,917

DATED : July 16, 1985

INVENTOR(S) : Clifford S. Jacobs

It is certified that error appears in the above-identified patent and that said Letters Patent is hereby corrected as shown below:

In Claim 1, second to last line, delete the word "nove" and insert therefore --move--.

Signed and Sealed this

*Twenty-ninth* Day of *October 1985*

[SEAL]

*Attest:*

DONALD J. QUIGG

*Attesting Officer*

*Commissioner of Patents and Trademarks—Designate*